United States Patent [19]

Harmon et al.

[11] Patent Number: 4,798,408

[45] Date of Patent: Jan. 17, 1989

[54] ADJUSTABLE LATCHING MECHANISM

[75] Inventors: Raymond E. Harmon, Orange; William R. E. McCown, Montclair; Frank A. Zankich, San Pedro, all of Calif.

[73] Assignee: Rexnord Inc., Brookfield, Wis.

[21] Appl. No.: 93,307

[22] Filed: Sep. 4, 1987

Related U.S. Application Data

[63] Continuation of Ser. No. 854,978, Apr. 23, 1986, abandoned.

[51] Int. Cl.[4] ..... E05C 21/02

[52] U.S. Cl. ..... 292/341.18

[58] Field of Search ..... 292/155, 113, 341.18, 292/341.19, 240, 241, DIG. 60; 411/304

[56] References Cited

U.S. PATENT DOCUMENTS

| | | | |
|---|---|---|---|
| 420,298 | 1/1890 | Gmindr | 292/155 |
| 1,941,031 | 12/1933 | Johanson | 292/155 X |
| 2,265,691 | 12/1941 | Hogg | 292/341.18 |
| 2,904,141 | 9/1959 | Henrichs | 292/341.18 X |
| 4,475,858 | 10/1984 | Benjamin et al. | 411/304 |
| 4,530,529 | 7/1985 | Poe et al. | 292/113 |

*Primary Examiner*—Richard E. Moore

[57] ABSTRACT

An adjustable latching mechanism is provided having a fixture (12, 13) which contains a rotatable element (14) and restrains that element from movement linearly along its axis. Also provided is a member (15) which is positioned intermediate the rotatable element (14) and the connecting element (10), e.g. a latch keeper, and intermediate the fixture (13) and the connecting element (10). The intermediate member (15) translates rotational movement of the rotatable element (14) into linear movement of the connecting element (10), allowing infinitely small, non-incremental adjustment of the position of the connecting element (10) relative to the structures joined by the mechanism. The connecting element (10) is restrained against rotational movement. A sleeve-like member (47) is fitted around a portion of the fixture (12) and prevents inadvertent dislodging of a pin (30) inserted through the connecting element (10) and contained within slots (28, 29) in the fixture (12).

16 Claims, 3 Drawing Sheets

10
11
12
13
14
15
16
17
18a
18b
18c
19
20
21
23
24
26
27
28
29
30
32
33
34
36
37
40
42
44
46
47
49
A

ADJUSTABLE LATCHING MECHANISM

This is a continuation of co-pending application Ser. No. 854,978 filed on Apr. 23, 1986 abandoned.

TECHNICAL FIELD

The present invention relates to mechanisms which permit adjustment of the position of the mechanism relative to the structures joined by the mechanism. In particular the present invention is directed to latch mechanisms.

BACKGROUND

The prior art in latch technology teaches various ways by which a latch mechanism may be adjusted for optimum performance in its intended use. In almost all cases the adjustment feature is designed specifically for the particular latch mechanism and thus is useful only in that particular application.

The present invention is directed for use in a variety of latch mechanisms, most notably in the hook latch and keeper type mechanisms. Its adaptability to more than a single application may be attributed to its structural components which are uniquely arranged to provide optimum performance in all aspects of the latching function, i.e. manual adjustment, load application, repair and replacement of components, etc. The uniqueness and advantages provided by the invention which are not available from the prior art will be described and explained in detail in the description which follows.

SUMMARY OF THE INVENTION

The present invention is an adjustable latching mechanism which is used to secure structures together, e.g. two parts of an aircraft, and allow an adjustment in the connection therebetween. The invention includes a connecting element and an adjusting assembly to accomplish this goal. The connecting element may be of conventional design. The adjusting assembly however includes a fixture portion, which mounts the mechanism to one or the other of the two structures, a rotatable element restrained in linear movement by the fixture, and a member, positioned intermediate to the rotatable element and the connecting element, which translates the rotational movement of the rotatable element into linear movement of the connecting element. The movement translating member is slidable with respect to the rotatable element but threadably engaged by both the fixture and the connecting element.

Further details of the construction of the invention and the advantages gained thereby are disclosed in the description which follows and the accompanying drawings.

DETAILED DESCRIPTION OF A PREFERRED EMBODIMENT

Figures 1, 1A, 1B:
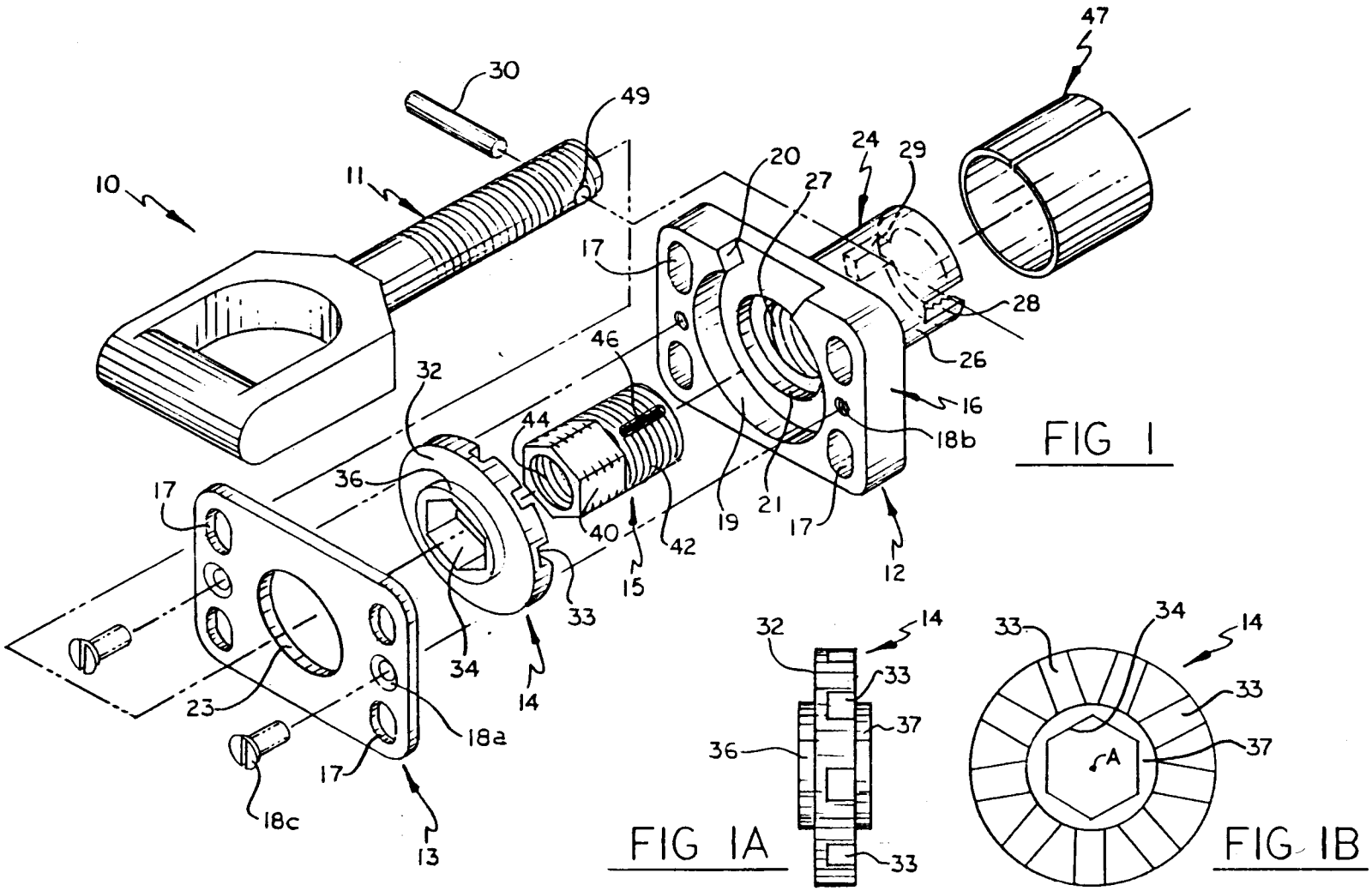
FIG. 1 is an exploded view in perspective of a preferred embodiment of the present invention.
FIG. 1A is a side elevational view of the rotatable member of the preferred embodiment.
FIG. 1B is a view of what is shown in FIG. 1A, rotated ninety degrees.
Figure 2:
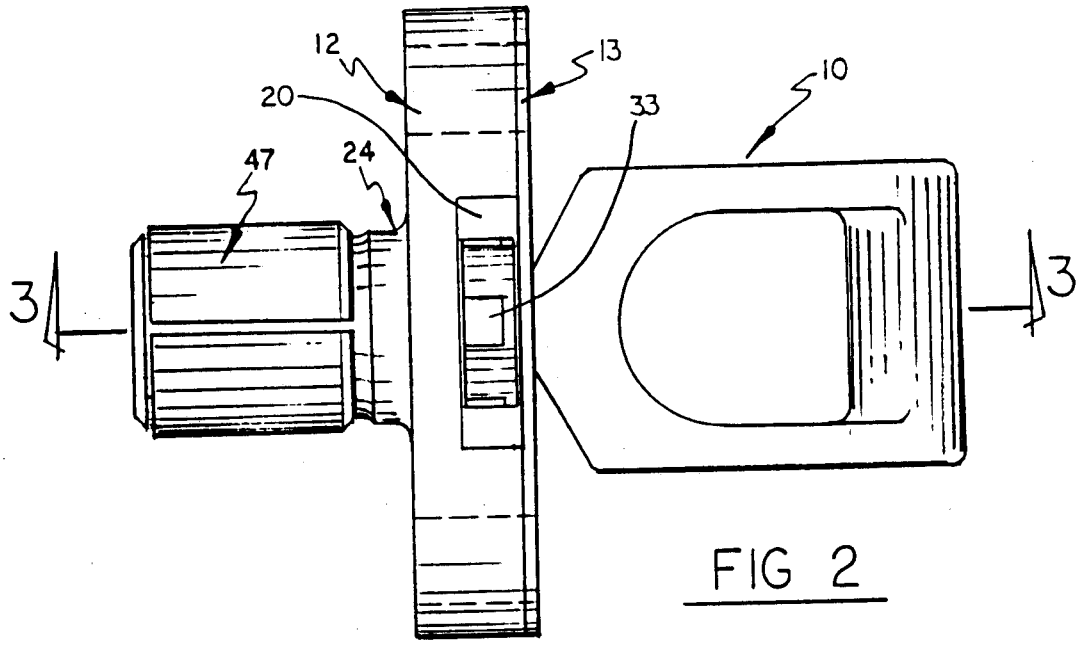
FIG. 2 is a top plan view of the preferred embodiment in assembled form.

In the drawings like reference numerals are used throughout the several views to indicate identical or like elements. With this in mind a preferred embodiment of the invention will be first explained followed by a brief description of an alternate embodiment.

FIG. 1 illustrates in detail the various components of the adjustable latch mechanism of the present invention. It should be noted that while a keeper-type mechanism is shown, the invention is not limited solely to use in such applications. The invention may be adapted for use in the hook portion of a latch mechanism, as well as other types of mechanisms requiring the type of adjustment possible with the present invention.

The components of the invention are a connecting element, e.g. a keeper, and an assembly for adjusting the position of the connecting element relative to the two items which are being joined by the latch mechanism. The connecting element 10 may be, and is shown in the drawings as, a conventional type well known in the art. The connecting element has an externally threaded portion 11 for purposes to be explained hereinafter. The adjusting assembly, on the other hand, is composed of several elements. These include a fixture 12, 13, a rotatable element 14, and a member 15 which translates rotational movement of the rotatable element 14 into linear movement of the connecting element 10.

The fixture 12,13 of the preferred embodiment, is constructed for mounting to one of the structures which is to be secured by the latch mechanism. A first and major portion of the fixture is a housing-type structure 12 having two distinct portions. A forward portion 16 is typically rectangular in shape and includes any selected number of openings 17 extending through it for permitting screws, bolts or other type of fastener (not shown) to be inserted therethrough for mounting the fixture 12, 13 to a prepared surface on one of the structures (not shown). The forward facing side of this portion 12 includes a recessed area 19, in this case circular in shape. The recessed area is open at its uppermost end to define an access opening 20. The access opening 20 permits the user of the mechanism to insert a tool into the fixture for operating the adjusting assembly. The recessed area 19 also includes a centrally located opening 21.

A second portion of the fixture for the preferred embodiment is a cover plate 13, provided for enclosing the recessed side of the other fixture portion 12. The cover plate 13 includes openings 17 situated for alignment with the openings 17 in the first portion 12 of the fixture. The cover plate 13 also includes a centrally located opening 23 therein. The cover plate 13 includes apertures **18*a* which align with mating openings 18*b* in the major portion 12 into which fasteners 18*c* are installed for fixing the cover plate 13 securely to the major portion 13** of the fixture.

Rearward of the fixture first portion 12 is a cylindrical shaped portion 24 which in the preferred embodiment has a relatively smooth outer wall 26 and a threaded internal wall or through-hole 27 extending therethrough. The throughhole 27 communicates directly with the opening 21 in the forward portion 16.

Both the diameter of the threaded through-hole 27 and that of the opening 21 must be of a size to permit the threaded portion 11 of the connecting element 10 to be threadably engaged and contained therein. At the rearwardmost end of the cylindrical portion 24 are a pair of oppositely positioned slots 28,29. Each slot has a closed end and an opposite open end. The slots 28,29 are aligned so as to permit entry and travel of a pin 30 or like rigid element along their length.

The adjusting assembly further includes a rotatable element 14. In the preferred embodiment the rotatable element has a substantially circular or disk-like shape. The forward side 32 is relatively flat in construction, with the rearward side having any selected number of notched or recessed opening 33 into which a tool (not shown) may be inserted for rotating the element 14 about its axis A. A central portion of the rotatable element 14 is removed to form a non-circular opening 34. In the preferred embodiment the non-circular opening 34 is formed as a hex-shaped opening. A raised area 36 on the forward side 32 is configured so as to fit within the opening 23 of the cover plate 13. A like raised area 37 is provided on the back side of the rotatable element 14 and is of a size for fitting within and being contained by the opening 21 in the recessed side of the rectangularportion of the fixture 12. The construction of this extended portion 37 of the rotatable element 14 is selected in order to provide more engagement between the rotatable element and the cylindrical member 15 when the cylindrical element 15 is positioned in its furthest retracted position. See FIGS. 1, 1A, 1B, 3 and 4. The outer diameter of the rotatable element 14 cannot be greater than the diameter of the recessed area 19 in the fixture 12 for reasons which will become clear further below.

The mechanism in the preferred embodiment by which rotational movement of the rotatable element 14 is translated into linear movement of the connecting element 10 is a cylindrical member 15. This member 15 has a forward portion with an outer wall 40 shaped so as to conform with the configuration of the non-circular opening 34 of the rotatable element 14. The rearward portion, formed integral to the forward position, has outer threads 42. A threaded bore or through-hole 44 extends through the complete length of the member 15. The outer threaded diameter of the cylindrical member 15 mates with the inner threaded diameter of the threaded through-hole 27 of the fixture 12. While the inner threaded diameter of the cylindrical member 15 mates with the threaded diameter of the threaded portion 11 of the connecting element 10.

A friction element 46 of conventional manufacture, e.g. a plug of plastic material, is installed in a portion of the cylindrical member's outer threaded portion. This provides a restraining or locking feature for the adjusting assembly.

The final component of the preferred embodiment is a split sleeve-like member 47 which is constructed so as to fit tightly over and around the cylindrical portion 24 of the fixture 12. This member 47 is installed after the pin 30 has been inserted through the slots 28, 29, and allows the use of a free-floating pin rather than a conventional press-fit roll pin, if desired. In the preferred embodiment the pin 30 serves as an anti-rotation element for the connecting element 11.

To assemble the preferred embodiment the following steps are taken: Cylindrical member 15 is first threaded into the major portion 12 of the fixture to a present depth within the rearward portion 24. The forward portion 40 is thus positioned forward of the fixture portion 16. The rotatable element 14, with recessed opening 33 facing the fixture portion 12, is next placed onto the forward portion 40 of the cylindrical member 15. The cover plate 13 of the fixture is then secured to the fixture portion 12 by the fasteners 18C, thus containing the rotatable element 14 within the fixture. Following this step, the position of the cylindrical member 15 is adjusted by rotating the rotatable element 14 with a tool until the forward end of the cylindrical member 15 is positioned flush with the forward or outer face of the cover plate 13, as shown in FIG. 4. The connecting element portion 11 is then threaded into the adjusting assembly into mating engagement with the inner threads of the cylindrical member 15, to a predetermined depth. This predetermined depth is represented by the alignment of the pin-receiving through-hole 49 in the connecting element portion 11 with the slots 28, 29 in the fixture rearward portion 24. When this through-hole 49 is in alignment with the slots 28, 29, the pin 30 may be inserted through the slots and through the connecting element through-hole 49. The sleeve-like member 47 may then be force fitted over this area of the fixture and deformed when in place to insure that the pin does not inadvertently become dislodged from the slots and the connecting element. See FIGS. 3 and 4. The preferred embodiment is now ready for mounting and use.

Figure 3:
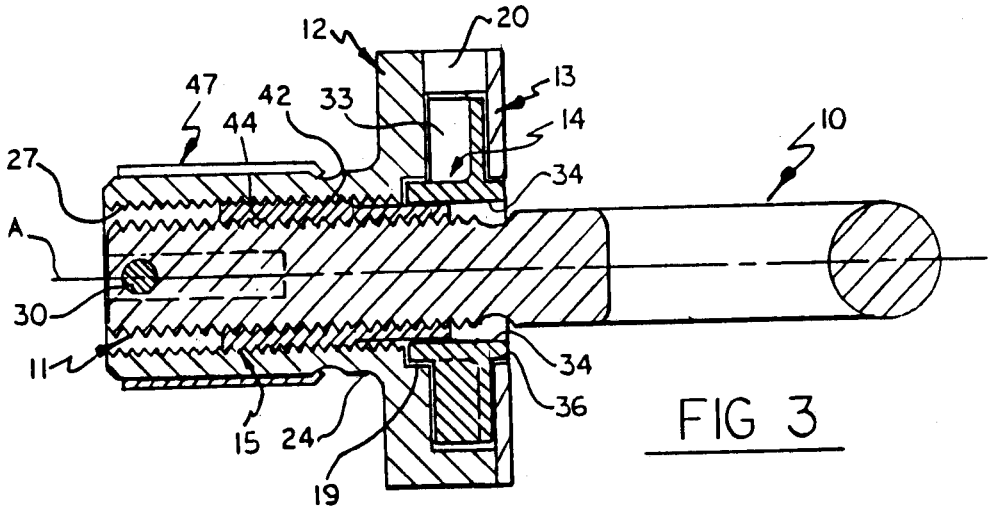
FIG. 3 is a view in cross-section of the preferred embodiment as seen generally along lines 3—3 in FIG. 2.
Figure 4:
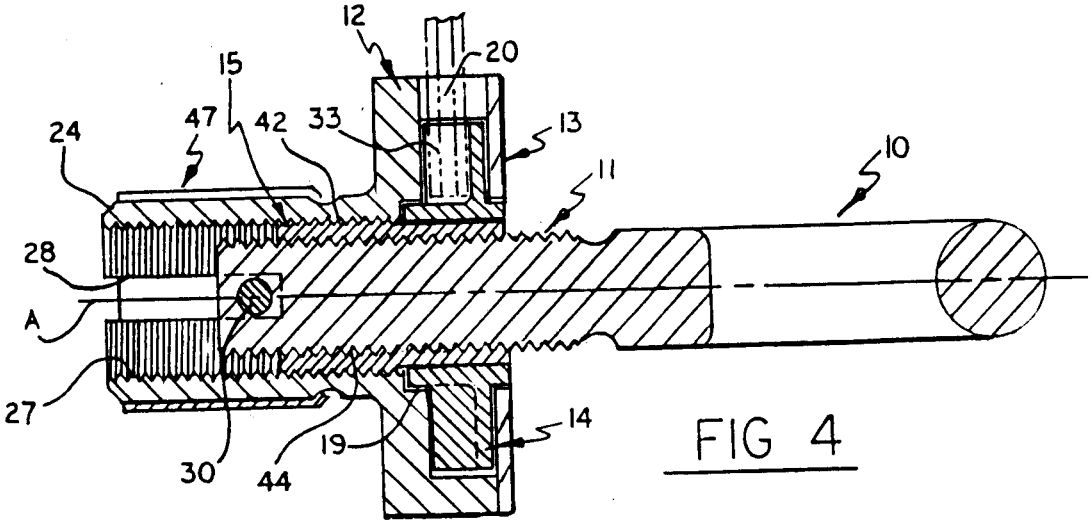
FIG. 4 is a view in cross-section of the preferred embodiment as it would appear when adjusted to its fully extended position.

The operation of the invention may be appreciated from a study of FIGS. 3 and 4. In FIG. 3 the connecting element 10, is shown in a retracted condition. From this it can be appreciated that the connecting element 10 is contained by the cylindrical member 15. All movement of the connecting element along the axis A is a direct result of movement of the cylindrical member 15. Movement of the cylindrical member 15 is directed by rotational movement of the rotatable element 14. The rotatable element may only be operated by a tool being inserted through the access opening 20 into one of the tool receiving slots 33. In FIG. 3 the tool is shown in phantom. Rotational movement of the rotatable element 14 causes rotational movement of the cylindrical member 15 as a result of the interfitting relationship of the non-circular opening 34 and the non-circular outer wall 40 of the member 15. Because the connecting element 10 is restricted from rotating relative to the fixture 12 by the pin 30, the rotational movement of the cylindrical member 15 becomes translated into linear movement of the connecting element as the cylindrical member 15 rotates with the rotatable element 14 and around the connecting element 10. The connecting element can only move linearly as the cylindrical member 15 rotates and slides relative to the rotatable element 14. Thus as can be seen in a comparison of FIGS. 3 and 4, as the rotatable element is rotated, in one direction, the cylindrical member 15 advances forward to the extent permitted by the length of its non-circular wall area 40 in combination with the length of the fixture slots 28,29 containing the connecting element pin 30. As the cylindrical member 15 rotates and advances forward, the connecting element threaded portion must respond but can do so in a linear motion only. Depending on the direction the rotatable element is rotated and upon the fineness of the threads selected for the various parts of the preferred embodiment, the connecting element may be adjusted in infinitely small, non-incremental amounts forward and rearwardly.

Figure 5:
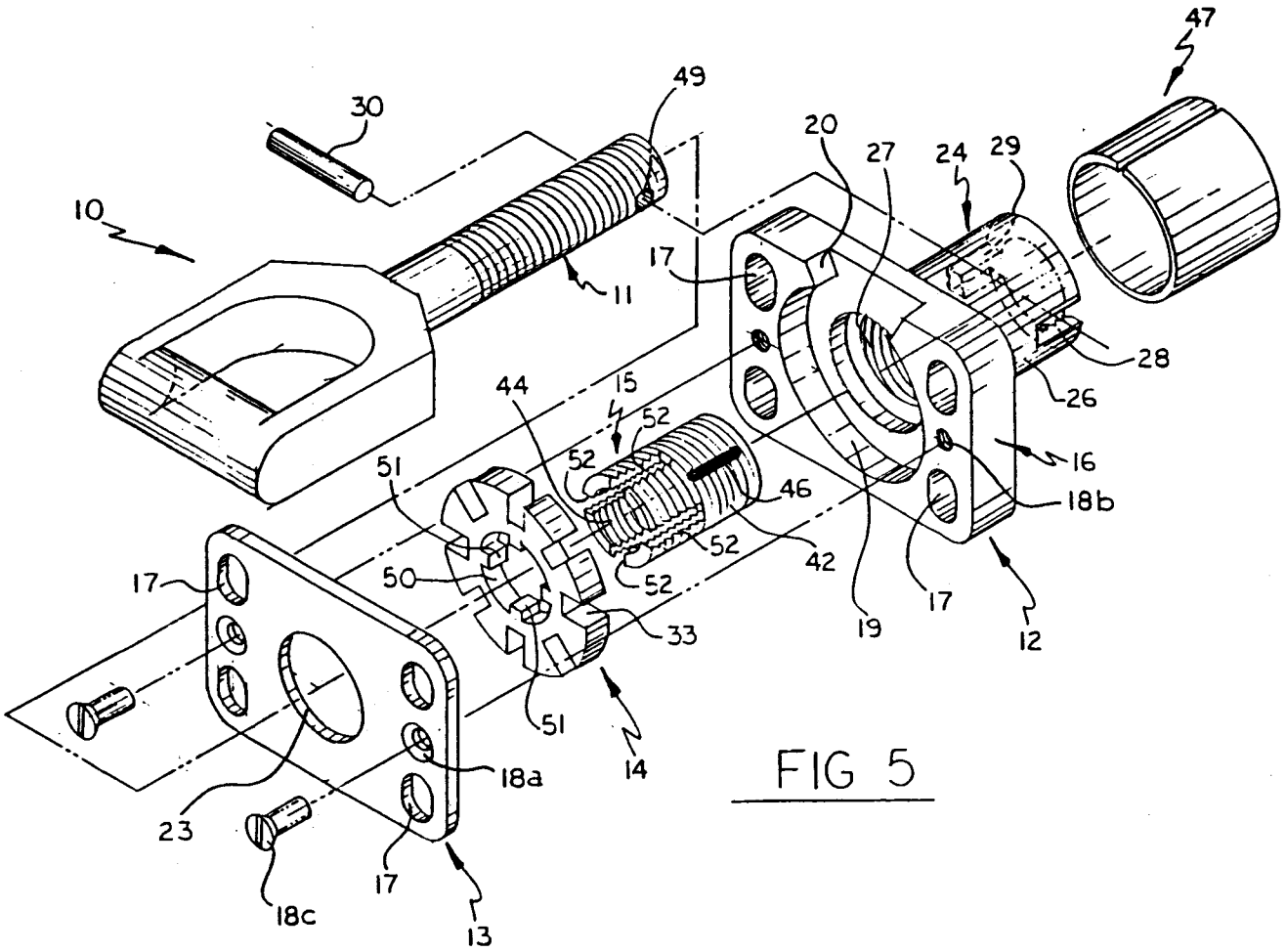
FIG. 5 is an exploded view in perspective of an alternate embodiment of the present invention.

An alternate embodiment is shown in FIG. 5 in which the mating structure of the rotatable element 14 and the cylindrical member 15 is altered. In this embodiment the central opening 50 of the rotatable element 14 is circular in shape and has at least one tab-like potion 51 projecting inward towards the axis A of the element. In FIG. 5, four tab-like portions 51 are shown spaced equally about the diameter of the circular opening 50. The cylindrical member 15 is now threaded throughout its length and four slotted areas 52 are provided in a portion of the forward end. The slotted areas 52 are arranged to each receive one of the tab-like portions 51. In this embodiment the tab-like portions 51 of the rotatable element 14 slide or travel within their respective slots 52 in the cylindrical member 15 to allow translation of movement by the cylindrical member 15 between the rotatable element 14 and the connecting element 10. In all other respects the assembly and operation of the invention remain the same as for that of the preferred embodiment.

The advantages of the invention may now be appreciated. A primary advantage results for the use of the invention over the use of a prior art device such as those shown in U.S. Pat. No. Re. 31,935 to Poe issued July 2, 1985 and U.S. Pat. No. 4,478,446 to Duran issued Oct. 23, 1984. When a latch under load is to be adjusted, the construction of the invention will permit the user to accomplish the adjustment without exerting considerable force as may be required by the mentioned prior art devices. This is the result of the use of the linearly confined but floating rotatable element which is not itself under load as is the starwheel in both the Duran and Poe patents. In the present invention, the rotatable element is relatively free for rotation purposes in that the load on the latching mechanism is not being directly transferred through it. Instead the unique structural arrangement of the rotatable element and the cylindrical member prevents the load from being transferred to the rotatable element. Accordingly, when a person inserts a tool into the fixture and thus into a slot of the rotatable element, less force will be required to rotate the element and hence adjust the mechanism. This feature of the invention provides the industry with a significant advance in that the ease by which a person may make adjustments to the latching mechanism is an important performance criteria for adjusting mechanisms. Specifically, the invention allows the user to obtain a more accurate torque reading because the rotatable element is not bearing under a load against the fixture. Further, easier, more accurate adjustment can be directly related to the amount of abuse and wear which the mechanism is subject.

A second advantage of the invention over the prior art devices follows from the first because of the use of the cylindrical member. In the invention a friction element 46 is used to prevent inadvertent movement of the mechanism. Because the cylindrical member 15 employs both outer and inner threads 42, 44 respectively, in combination with a friction element 46, much finer adjustment are possible for the user than are permissable with the prior art devices. In the aircraft industry fine adjustments are often critical to the proper functioning of the aircraft. Accordingly, the present invention will allow a degree of adjustment which is not permissable when the mechanism must be locked against inadvertent movement by the use of prior art detents or plunger-like devices which pre-set the amounts of adjustment available to the user.

Another advantage of the present invention is the safety feature provided by the use of the sleeve-like member 47 to contain the pin 30 in the connecting element 10. It is not uncommon for pins in prior art designs to become dislodged under operating circumstances and as a result release the keeper or connecting element causing serious damage to the aircraft or the surrounding structures. The construction of the present invention insures, to the extent possible under realistic circumstances, that the pin will not be the cause of a failure by the latching mechanism.

In view of the foregoing it should be clear that the invention affords advantages and a degree of flexibility in design which is not provided by any known prior art device. Other embodiments for the invention from those shown in the drawings may be possible to persons skilled in this art field. Accordingly, the scope of the protection for this invention is believed limited only by the claims which follow.

What is claimed is:

1. An adjustable latching mechanism constructed and arranged for securing a first structure relative to a second structure, said mechanism comprising:

a connecting element for joining a first structure to a second structure, said connecting element having a portion with threads thereon;

an assembly for adjusting the position of said connecting element relative to the structures;

said assembly including a rotatable element tool-operable for rotation about an axis, a fixture constructed and arranged for securement to one of the structures, said fixture having a first portion containing a threaded through-hole therein of pre-determined length and diameter, and a second portion, forward of said first portion, constructed and arranged to contain said rotatable element in a manner permitting a pre-determined range of movement along said axis, said rotatable element having a central portion with a through-hole therein, said assembly further including means, separate from said rotatable element, for translating rotational movement of said rotatable element into linear movement of said connecting element, said means including a first forward portion constructed and arranged for interfitting mounting in said rotatable element through-hole, a second rearward portion having outer threads permitting threaded engagement within said fixture threaded through-hole, and a threaded through-hole of a size permitting threaded engagement of said connecting element threaded portion therein; and means for preventing rotational movement of said connecting element within said assembly as said rotatable element is rotated.

2. The mechanism of claim 1 further including means for preventing said rigid element from being dislodged from said connecting element and said slot, said means including a sleeve-like member positioned in fixed relationship around said fixture threaded portion in a manner confining said rigid element within said slot.

3. The mechanism of claim 1 wherein said rotatable element through-hole has a non-circular configuration and said means for translating rotational movement into linear movement is a cylindrical element having a configuration at said first forward portion identical to said non-circular configuration of said rotatable element through-hole.

4. The mechanism of claim 1 wherein said rotatable element through-hole is circular and has at least one rigid tab-like portion extending inward towards said axis, and said means for translating rotational movement into linear movement is a cylindrical element, said cylindrical element having at least one slot in said first forward portion for receiving and containing therein said rigid tab-like portion of said rotatable element.

5. An adjustable latching mechanism constructed and arranged for securing a first structure relative to a second structure, said mechanism comprising:

a connecting element for joining a first structure to a second structure; said connecting element having a portion with threads thereon;

an assembly for adjusting the position of said connecting element relative to the structures, said assembly including a rotatable element tool-operable for rotation about an axis, a fixture constructed and arranged for securement to one of the structures, said fixture having a first portion containing a threaded through-hole therein of pre-determined length and diameter, a second portion, forward of said first portion, constructed and arranged to contain said rotatable element in a manner permitting a pre-determined range of movement along said axis, said rotatable element having a central portion with a non-circular through-hole therein, said assembly further including means, separate from said rotatable element, for translating rotational movement of said rotatable element into linear movement of said connecting element, said means being a cylindrical member and including a first forward portion constructed and arranged for interfitting mounting in said rotatable element through-hole, a second rearward portion having outer threads permitting threaded engagement within said fixture threaded through-hole, and a threaded through-hole of a size permitting engagement of said connecting element threaded portion therein;

means for preventing rotational movement of said connecting element within said assembly as said rotatable element is rotated; and means for preventing non-tool operated movement of said assembly, said means including a friction element secured in said outer threaded portion of said movement translating means, said friction element engaging said threaded first portion of said fixture.

6. The mechanism of claim 5 further including means for preventing said rigid element from being dislodged from said connecting element and said slot, said means including a sleeve-like member positioned in fixed relationship around said fixture threaded portion in a manner confining said rigid element within said slot.

7. An adjustable latching mechanism constructed and arranged for securing a first structure relative to a second structure, said mechanism comprising:

a connecting element for joining a first structure to a second structure, said connecting element having a portion with threads thereon;

an assembly for adjusting the position of said connecting element relative to the structures;

said assembly including a rotatable element tool-operable for rotation about an axis, a fixture constructed and arranged for securement to one of the structures for mounting thereon, said fixture having a first portion containing a threaded through-hole therein of pre-determined length and diameter, and a second portion, forward of said first portion, constructed and arranged to contain said rotatable element in a manner permitting a pre-determined range of movement along said axis, said rotatable element having a central portion with a through-hole therein having at least one rigid tab-like portion extending inward towards said axis, said assembly further including means, separate from said rotatable element, for translating rotational movement of said rotatable element into linear movement of said connecting element, said means being a cylindrical member and including a first forward portion having at least one slot for interfitting mounting with said tab-like portion in said rotatable element through-hole, a second rearward portion having outer threads permitting threaded engagement within said fixture threaded through-hole, and a threaded through-hole of a size permitting threaded engagement of said connecting element threaded portion therein;

means for preventing rotational movement of said connecting element within said assembly as said rotatable element is rotated; and means for preventing non-tool operated movement of said assembly, said means including a friction element secured in said outer threaded portion of said movement translating means, said friction element engaging said threaded first portion of said fixture.

8. The mechanism of claim 7 further including means for preventing said rigid element from being dislodged from said connecting element and said slot, said means being a sleeve-like member positioned in fixed relationship around said fixture threaded portion in a manner confining said rigid element within said slot.

9. An adjustable mechanism for use with a latch mechanism for securing a first member relative to a second member, said adjustable mechanism comprising:

a housing having a threaded housing bore therein;

an intermediate member having a threaded inner diameter and a threaded outer diameter received by said threaded housing bore;

a latch connecting element having a threaded shaft received by said threaded inner diameter of said intermediate member;

a rotatable element mounted within said housing having an aperture therein for receipt of said intermediate member; and means within said rotatable element aperture and said intermediate member for imparting a rotational and linear motion to said intermediate member and thereby imparting a linear motion to said latch connecting element, said rotatable element being substantially load free.

10. An adjustable mechanism, as claimed in claim 9, wherein:

said means within said rotatable element aperture and said intermediate member are a non-circular aperture within said rotatable element and an end portion on said intermediate member having a configuration substantially identical to said non-circular aperture.

11. An adjustable mechanism, as claimed in claim 9, wherein:

said means within said rotatable element aperture and said intermediate member are at least one rigid tablike portion extending into said aperture and at least one slot in an end portion of said intermediate member for receiving said rigid tab-like portion.

12. An adjustable mechanism, as claimed in claim 9, additionally comprising:

friction means on at least one of said threads for preventing rotation of said mechanism.

13. An adjustable mechanism, as claimed in claim 9, additionally comprising:

friction means secured between said threaded outer diameter of said intermediate member and said threaded bore of said housing.

14. An adjustable mechanism, as claimed in claim 9, additionally comprising:

means for preventing rotational movement of said connecting element within said housing during rotation of said rotatable element.

15. An adjustable mechanism, as claimed in claim 9, additionally comprising:

said housing having a slot within said threaded housing bore; and means inserted through said threaded shaft of said connecting element for engaging said slot to prevent rotation of said connecting element.

16. An adjustable mechanism, as claimed in claim 15, additionally comprising:

means mounted upon said housing about said threaded housing bore for preventing said means for engaging said slot from being dislodged therefrom.

* * * * *

UNITED STATES PATENT AND TRADEMARK OFFICE

CERTIFICATE OF CORRECTION

PATENT NO. : 4,798,408

DATED : January 17, 1989

INVENTOR(S) : Raymond E. Harmon, William R.E. McCown, & Frank A. Zankich

It is certified that error appears in the above-identified patent and that said Letters Patent is hereby corrected as shown below:

Claim 2, line 1 (Col. 6, line 53), after "claim 1" insert -- wherein said means for preventing rotational movement of said connecting element includes a slot in said fixture first portion and a rigid element inserted through said connecting element so as to be positioned in said slot, and --

Claim 6, line 1 (Col. 7, line 49), after "claim 5" insert -- wherein said means for preventing rotational movement of said connecting element includes a slot in said fixture first portion and a rigid element inserted through said connecting element so as to be positioned in said slot, and --

Claim 8, line 1 (Col. 8, line 29), after "claim 7" insert -- wherein said means for preventing rotational movement of said connecting element includes a slot in said fixture first portion and a rigid element inserted through said connecting element so as to be positioned in said slot, and ---

Signed and Sealed this

Sixteenth Day of March, 1993

*Attest:*

STEPHEN G. KUNIN

*Attesting Officer*

*Acting Commissioner of Patents and Trademarks*